United States Patent [19]

Goss

[11] Patent Number: 5,070,541

[45] Date of Patent: Dec. 10, 1991

[54] HAND/ARM PROTECTOR

[76] Inventor: Brenna L. Goss, P. O. Box 475, Weed, N. Mex. 88354

[21] Appl. No.: 519,928

[22] Filed: May 7, 1990

[51] Int. Cl.[5] ..... A41D 13/08

[52] U.S. Cl. ..... 2/16

[58] Field of Search ..... D2/16, 161 R, 161 A, D2/159, 162, 20, 169

[56] References Cited

U.S. PATENT DOCUMENTS

| | | | |
|---|---|---|---|
| D.299,562 | 1/1989 | Lee | 2/16 X |
| 375,958 | 1/1888 | Skeffington | 2/16 X |
| 632,547 | 9/1899 | Barth | 2/158 |
| 731,791 | 6/1903 | Krifka | 2/16 |
| 3,217,332 | 11/1965 | Gross | 2/16 |
| 3,423,095 | 1/1969 | Cox | 2/16 X |
| 4,785,478 | 11/1988 | Mosley | 2/161 A X |
| 4,809,366 | 3/1989 | Pratt | 2/161 A |

*Primary Examiner*—Werner H. Schroeder
*Assistant Examiner*—Sara M. Current

[57] ABSTRACT

The said invention as described is a protective covering protecting the back of the hand and forearm, while leaving the palm, fingers, and thumb uncovered to be used. The loops around the forefinger, pinky finger and thumb secure the protection in place on the back of the hand. The fastener at the inner wrist provides the protection with comfortable bending of the wrist. The fasteners along the length of the forearm secure the invention around the forearm. The protection can be put on quickly and solely, therefore to be useful and practical.

1 Claim, 1 Drawing Sheet

HAND/ARM PROTECTOR

INTRODUCTION

The Pekker Protector is a covering that protects the back of the hand and forearm from the scarring pecks of hens, while leaving the palm, fingers and thumb uncovered to feel and gather eggs from underneath hens. The Pekker Protector can be put on fast, solely and easily. After being put on, the protection is secure for the entire use. It is constructed to be very durable, comfortable and practical. The following presentation describes the type of protection necessary to prevent the daily scarring of hen pecks.

BACKGROUND OF THE INVENTION

The egg gatherers that have to gather thousands of eggs a day from underneath angry hens without removing the hen from the nest, which would disturb the laying habits, have endured the scarring hen pecks to the back of the hand and forearm. Gatherers have tried many ways to keep the scarring pecks from penetrating the skin. Since the palm, fingers and thumb must be uncovered to provide a practical protection, and the use of only one hand is available for fastening, the ways of protecting both the back of the hand and forearm are limited. Providing the necessary protection while keeping the hand/wrist useable is the present invention.

SUMMARY

As a protective covering, protecting the back of the hand and forearm, the present invention leaves the palm, fingers and thumb uncovered for its specific use. Secured to be very comfortable, constructed to be durable, this invention is the needed protection against the scarring hen pecks to the egg gatherer's hand and forearm.

DETAILED DESCRIPTION

Figure 1:
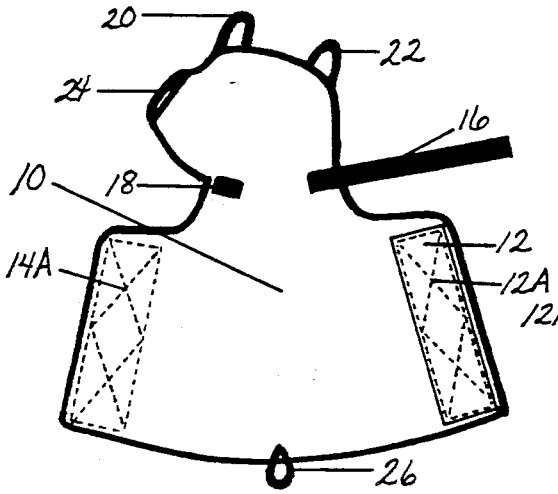
FIG. 1—the outside of the protector
Figure 2:
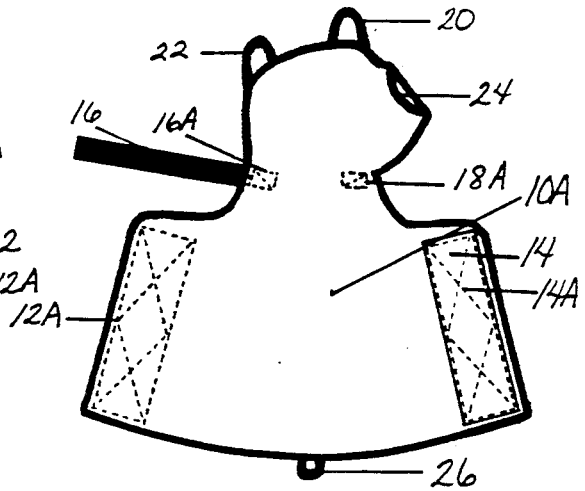
FIG. 2—the inside of the protector
Figure 4:
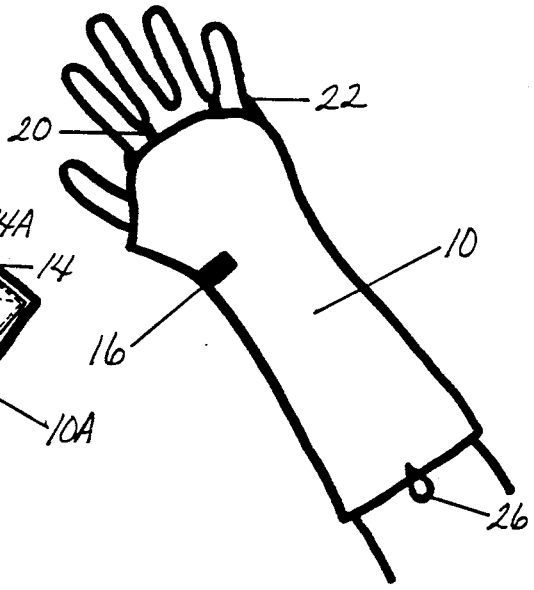

The hand/arm protector 10,10A is constructed of any material thick enough to withstand pecks from a hen. I have chosen lightweight chap cowhide. The leather is cut to size from the pattern, the shape you see in FIG. 1. The fasteners 12,14,16,18 which fasten the forearm's protection need to be selected with the fact in mind that the use of only one hand is available for fastening, I have chosen hook and loop fastener material such as the type sold under the trademark VELCRO. Hook fastener 12,18 and loop fastener 14, 16 are cut in length and glued in position to the protector 10,10A as can be seen in FIGS. 1 and 2. The forefinger loop 20, pinky finger loop 22 and thumb loop 24 need to be cut to length. I have chosen braided elastic of 70% polyester and 30% rubber. These loops 20,22,24 are also positioned and glued before being permanently attached to protector 10,10A. After the glue has dried, the fasteners 12,14,16,18 and loops 20,22,24 are permanently attached. I have chosen to sew them with cotton covered polyester, heavy duty thread. The VELCRO-type fasteners 12,14 are sewn around the edges and reinforced with a triangle pattern 12A,14A, VELCRO-type fasteners 16, 18 are sewn around the edges 16A,18A. A loop 26 is sewn to the outside of protector as seen in FIGS. 1 and 4, to hang the protector on when it is not in use, so elastic loops 20,22,24 will not be stretched out of shape. I have chosen this loop to be made of leather. This construction is very durable, comfortable and practical.

Figure 3:
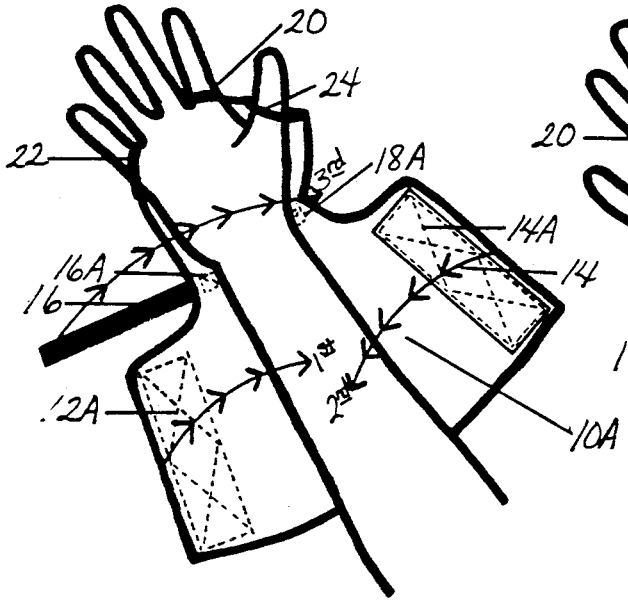
FIG. 3—shows position of hand/arm in relation to the inside view of protector, also showing the order in which the protector is fastened, coinciding with the fastener that are chosen to use FIG. 4—the protector as appears when fastened and ready for use.

It is essential that the described invention can be put on the hand/arm in a very short time. As seen in FIG. 3, with protector 10A laying on a flat surface, with palm up, place the forefinger, pinky finger and thumb through coinciding loops 20,22,24. Fasten the VELCRO-type fasteners 14 overlapping 12, then VELCRO-type fastener 16 around wrist to 18. The hand/arm Protector is ready for use in a matter of seconds. With VELCRO-type fasteners the protector can be removed with one pull on the upper forearm top flap where the loop fastener is attached 14.

What is claimed is:

1. A hand and arm protector for protecting a wearer from hen pecks comprising:

a protective means made of leather material for covering each of a user's lower forearm, back of wrist, back of hand and a portion of the user's lower thumb while leaving the user's fingers, palm, and a portion of the thumb uncovered;

elastic loop means attached to said protective means for encircling only a user's thumb, index finger and pinky finger;

corresponding hook and loop fastener means for selectively securing said protective means around the user's forearm and wrist, wherein said corresponding hook and loop fastener means includes a first mating pair of hook and loop fasteners for attaching across the palm side of the user's wrist and a second mating pair of hook and loop fasteners for attaching said protective means about the user's lower forearm wherein said second mating pair of hook and loop fasteners extends along the length of the wearer's lower forearm so that said protective means can be removed by one continuous shearing-type motion of the user's other hand.

* * * * *